US006848203B2

(12) United States Patent
Hohmann et al.

(10) Patent No.: US 6,848,203 B2
(45) Date of Patent: Feb. 1, 2005

(54) BASE EDGE PROTECTION SYSTEM AND METHOD

(75) Inventors: Robert A. Hohmann, Peoria, IL (US); Richard E. Livesay, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/223,210

(22) Filed: Aug. 19, 2002

(65) Prior Publication Data

US 2004/0031175 A1 Feb. 19, 2004

(51) Int. Cl.[7] ..... E02F 3/36; E02F 9/29

(52) U.S. Cl. ..... 37/446; 37/449; 37/455; 37/457

(58) Field of Search ..... 37/449; 403/378, 403/379.3, 379.4; 371/446, 448, 400, 452, 455, 456, 457

(56) References Cited

U.S. PATENT DOCUMENTS

| | | | | | |
|---|---|---|---|---|---|
| 1,009,254 | A | * | 11/1911 | McKenzie | 37/450 |
| 1,807,632 | A | * | 6/1931 | McKee | 37/450 |
| 2,204,718 | A | * | 6/1940 | Younie | 37/456 |
| 2,723,699 | A | * | 11/1955 | Coates | 411/302 |
| 2,805,496 | A | * | 9/1957 | Jordan | 37/456 |
| 3,334,431 | A | * | 8/1967 | Phillips | 37/457 |
| 3,426,459 | A | * | 2/1969 | Peterson | 37/452 |
| 3,453,755 | A | * | 7/1969 | Trudeau | 37/456 |
| 3,466,772 | A | * | 9/1969 | Phillips | 37/457 |
| 3,585,741 | A | * | 6/1971 | Heusler | 37/455 |
| 3,664,044 | A | * | 5/1972 | Hahn | 37/456 |
| 3,685,177 | A | * | 8/1972 | Hahn et al. | 37/446 |
| 3,736,664 | A | * | 6/1973 | Black et al. | 37/446 |
| 3,812,608 | A | * | 5/1974 | Ratkowski | 37/448 |
| 3,841,007 | A | * | 10/1974 | Howarth et al. | 37/455 |
| 3,844,619 | A | * | 10/1974 | Haller | 299/108 |
| 3,845,578 | A | * | 11/1974 | Holmstrom | 37/446 |

(List continued on next page.)

FOREIGN PATENT DOCUMENTS

| | | | | |
|---|---|---|---|---|
| JP | 61176724 | * | 8/1986 | E02F/9/28 |
| WO | WO 02/12642 A1 | | 2/2002 | |

*Primary Examiner*—Thomas B. Will
*Assistant Examiner*—Thomas A Beach
(74) *Attorney, Agent, or Firm*—James R. Smith

(57) ABSTRACT

A base edge protection system is provided for use with a base edge having at least one securing structure attached therewith. The base edge protection system comprises a base edge protector having a shroud portion and a tail portion, attached to said shroud portion, which is structured and arranged to extend through a securing structure opening attached to the base edge. A retaining device is adapted for attachment to the tail portion and retains the base edge protector on the base edge by contact with the securing structure.

17 Claims, 4 Drawing Sheets

U.S. PATENT DOCUMENTS 3,881,262 A * 5/1975 Cullen ..... 37/455
3,947,982 A * 4/1976 Mantovani ..... 37/450
3,982,339 A * 9/1976 Nilsson ..... 37/454
4,027,408 A * 6/1977 Ramella et al. ..... 37/455
4,052,803 A * 10/1977 Lanz et al. ..... 37/449
4,071,967 A * 2/1978 Klett ..... 37/448
4,205,469 A * 6/1980 Johansson et al. ..... 37/457
4,360,981 A * 11/1982 Bierwith et al. ..... 37/450
4,414,764 A * 11/1983 Johansson et al. ..... 37/450
4,642,920 A * 2/1987 Lehnhoff ..... 37/452
4,782,607 A * 11/1988 Frisbee et al. ..... 37/455
5,052,134 A * 10/1991 Bierwith ..... 37/458
5,172,500 A * 12/1992 Renski et al. ..... 37/457
5,233,770 A 8/1993 Robinson
5,412,885 A 5/1995 Cornelius
5,553,409 A 9/1996 Irving
5,634,285 A 6/1997 Renski
5,653,048 A * 8/1997 Jones et al. ..... 37/452
5,806,215 A 9/1998 Matthews
5,806,216 A 9/1998 Renski
5,937,549 A * 8/1999 Bender et al. ..... 37/455
5,992,063 A 11/1999 Mack
6,032,390 A 3/2000 Bierwith
6,151,812 A * 11/2000 Bierwith ..... 37/455
6,240,663 B1 * 6/2001 Robinson ..... 37/458
2002/0000053 A1 1/2002 Adamic et al.

* cited by examiner

BASE EDGE PROTECTION SYSTEM AND METHOD

TECHNICAL FIELD

The present invention relates to a base edge protection system and, more specifically, a base edge protection system for use in protecting the base edge of a ground engaging implement of a work machine.

BACKGROUND

Mining and earthmoving operations require the use of a ground engaging implement such as a bucket. Numerous arrangements have been utilized in the past to protect the leading edge of the bucket's base edge. In some applications, a wear resistant member or base edge protector is welded to the base edge between respective tip assemblies to increase the life thereof. In other arrangements, individual base edge protectors have been bolted to the base edge between the respective tip assembles. In still other applications, the base edge protector is fastened to the individual tip assemblies by various forms of fasteners or mechanical interlock systems which oftentimes require the removal of at least a portion of the tip assembly in order to remove the base edge protector.

Because of the abrasive nature of the environment in which the buckets operate, the base edge protectors are susceptible to wear due to the high level of friction associated with their use. Accordingly, it is desirable to be able to quickly and easily remove a worn base edge protector and replace it with another. For those base edge protectors that are welded to the base edge, substantial dismantling of the bucket may be required to remove the base edge protector. Mechanical fastener methods, such as bolts or pins, of attaching the base edge protectors may result in deformation of the mechanical fastener due to forces these mechanical fasteners are required to withstand, thereby making more difficult the removal of the base edge protectors.

The present invention is intended to overcome one or more of the problems set forth above.

SUMMARY OF THE INVENTION

In accordance with an embodiment of the present invention, a base edge protector for use with a base edge having at least one securing structure attached therewith, the securing structure defining with the base edge a securing structure opening, is provided. The base edge protector comprises a shroud portion having a recessed portion for receiving the base edge and a tail portion, attached to the shroud portion, structured and arranged to extend through the securing structure opening.

In accordance with another embodiment of the present invention, a base edge protector system for use with a base edge having at least one securing structure attached therewith, the securing structure defining with the base edge an opening, is provided. The base edge protection system comprises a base edge protector comprising a shroud portion and a tail portion, attached to said shroud portion, which is structured and arranged to extend through the securing structure opening, and a retaining device adapted for attachment to the tail portion.

In accordance with yet another embodiment of the present invention, a method of providing an adjustable base edge protector system for protecting a base edge is provided. The method comprising the steps of: providing a base edge protector having a tail portion; providing the base edge with a securing device, the securing device defining with the base edge a securing device opening for receiving the tail portion, the securing device further comprising an abutment surface; and providing the tail portion with a retaining device adapted to engage the abutment surface and wherein variations in a position of the retaining device causes variations in a relative position of the base edge protector and the base edge.

DETAILED DESCRIPTION

Figure 1:
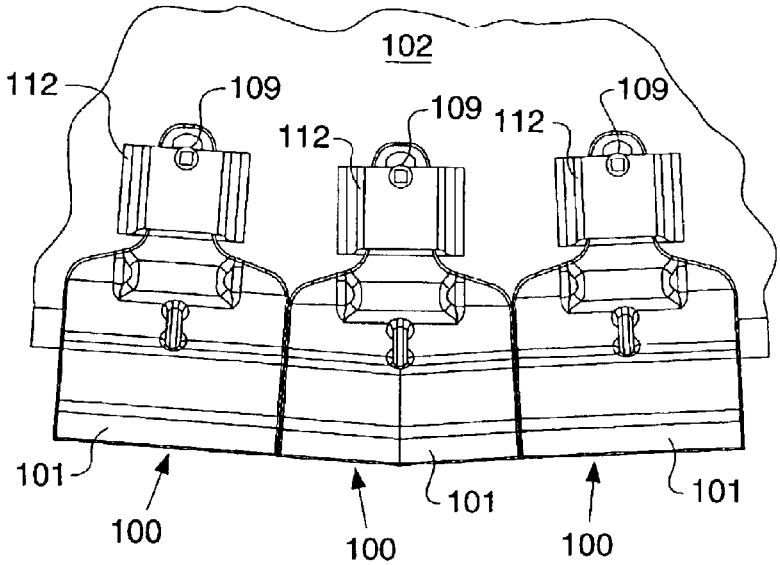
FIG. 1 is a top view of a plurality of base edge protection systems of the present invention shown attached to a base edge of a bucket.

With reference now to the Figures, shown in FIG. 1 are a plurality of base edge protection systems 100 of the present invention. Each base edge protection system includes a pair of base edge protectors 101 which are shown connected to a portion of a base edge 102 of a work tool such as a bucket (not shown). Each edge protector 101 is releasably attached to the base edge 102 by a retaining device 109. Although the specific details of the retaining device 109 will be disclosed as this disclosure progresses, suffice to say for now the retaining device 109, in conjunction with a securing structure 112 which is welded or otherwise secured to the base edge 102, is adapted to maintain the base edge protector 101 secured to the base edge 102.

Figure 2:
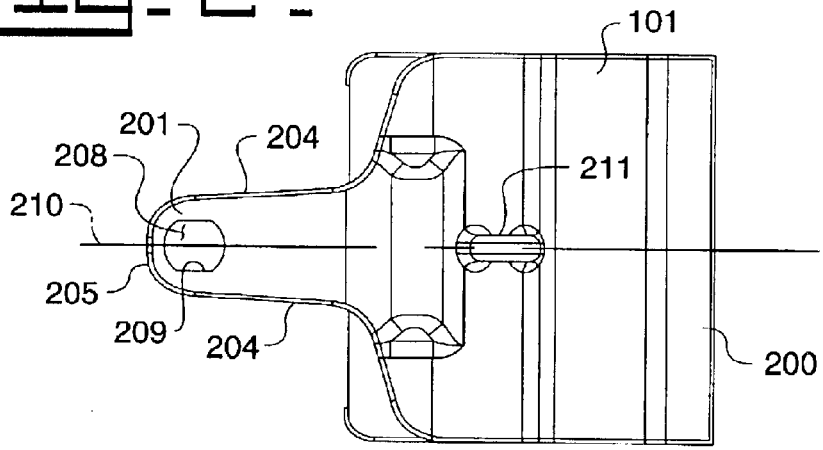
FIG. 2 is a top view of a base edge protector for use with the base edge protection system of the present invention.

With reference now to FIG. 2, a base edge protector 101 of the present invention is shown isolated from the bucket. The base edge protector 101 is comprised of a shroud portion 200 and an attached tail portion 201 having two side walls 204 and a tail portion end 205. As shown, the tail portion 201 includes a tail portion opening 208 adapted to receive the retaining device 109. For exemplary purposes, and as should become apparent as this disclosure progresses, the tail portion opening 208 may include at least one planar portion 209. To facilitate coupling the base edge protector 101 to the base edge 102, and as will become apparent as this disclosure progresses, at least one of the side walls 204 of the tail portion 201 is provided with a taper. In an embodiment of the present invention, the taper is defined by the distance from the side wall 204 to a base edge protector centerline 210 adjacent the shroud portion 200 which is greater than the distance from the side wall 204 to the base edge protector centerline 210 adjacent the tail portion end 205. The shroud portion 200 may further be provided with an attachment structure 211 which, in an embodiment of the present invention, may comprise a ring-like structure which is used to couple the base edge protector 101 to hoisting device (not shown) used for lifting the base edge protector 101.

Figure 3:
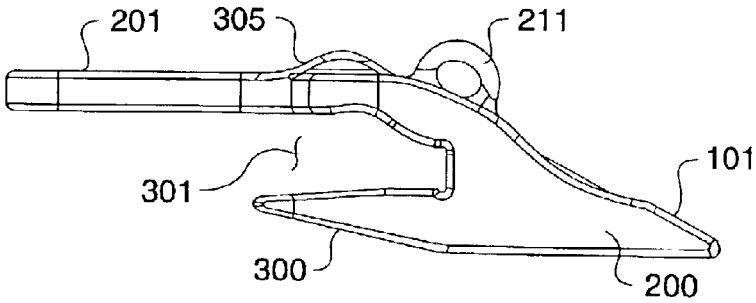
FIG. 3 is a side view of the base edge protector of FIG. 2.

Referring to the FIG. 3 side view of the base edge protector 101, the shroud portion 200 includes a leg portion 300 which, in cooperation with the tail portion 201, defines a recess 301 for receiving the base edge 102. The shroud portion 200 includes an elevated portion 305 attached thereon and is sized to be at least as high as the securing structure 112 when the base edge protector 101 is attached to the base edge 102. As should be appreciated by those of ordinary skill in such art, by sizing the elevated portion 305 in the above-described manner, the elevated portion 305 may protect the securing structure 112 from damage from material entering the bucket.

Figure 4:
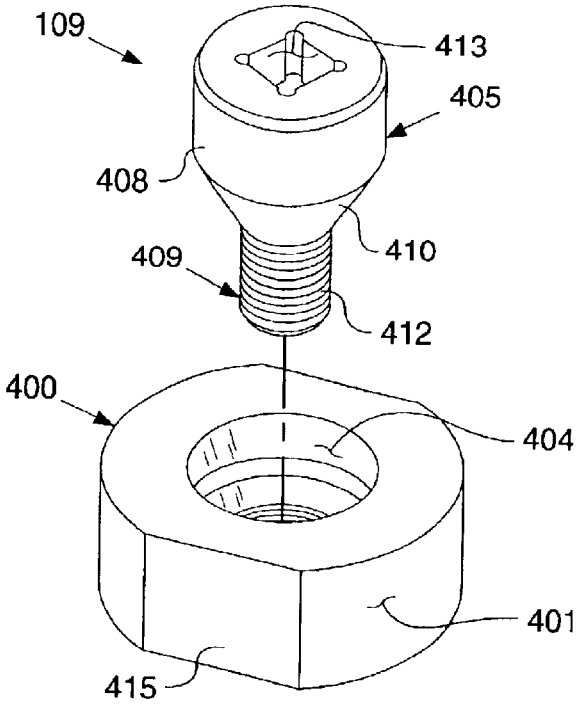
FIG. 4 is a perspective view of an embodiment of a retaining device for use with the base edge protector system of the present invention.
Figure 5:
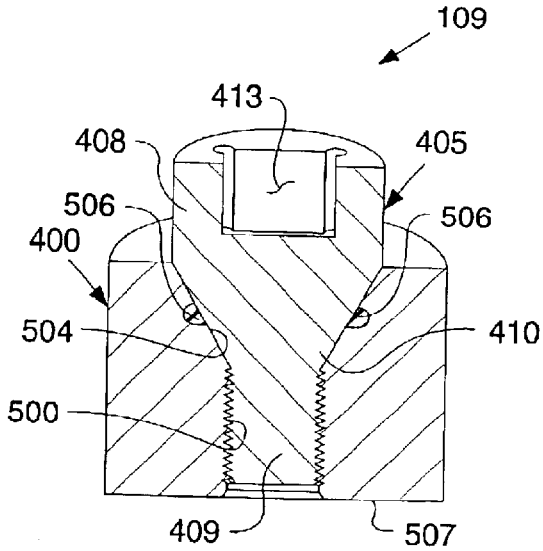
FIG. 5 is a cross-section view of the retaining device of FIG. 4 shown assembled.
Figure 6:
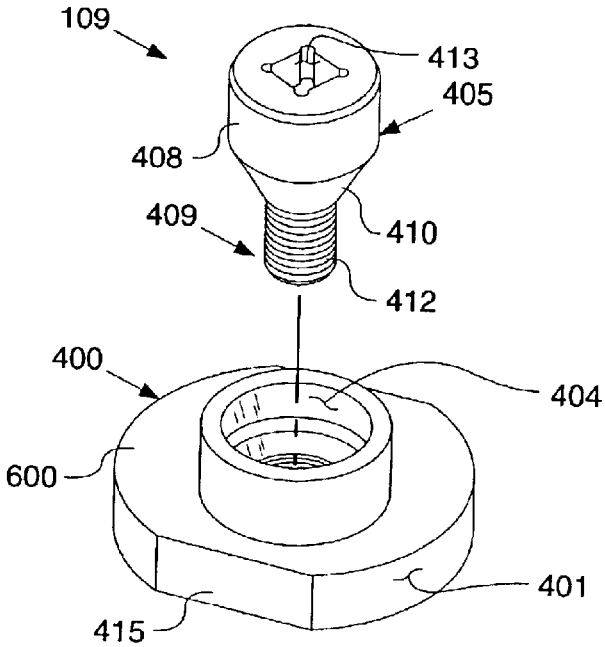
FIG. 6 is a perspective view of yet another embodiment of a retaining device for use with the base edge protector system of the present invention.

FIGS. 4 through 6 illustrate different embodiments of a retaining device 109 which are contemplated for use with the base edge protector 101 of the present invention. For all embodiments described herein in regards to FIGS. 4–6, like features for each described embodiment will be referenced by like reference numbers. Each retaining device 109 comprises an insert 400 composed of a rigid material having an outer periphery 401 shaped to correspond to the shape of the tail portion opening 208. Each insert 400 further includes an aperture 404 sized to receive a retaining member 405. In an embodiment of the present invention, the retaining member 405 includes a head portion 408, a shank portion 409, and a tapered neck portion 410 which forms the transition between the head portion 408 and the shank portion 409. The shank portion 409 includes a threaded portion 412 for engaging a corresponding threaded portion 500 (shown in FIG. 5) provided in the aperture 404. To facilitate attachment of the retaining member 405 to the insert 400, a recess 413 may be provided in the head portion 408 for receipt of a torque-providing tool (not shown).

With further reference to the FIG. 5 cross-sectional view, shown is the retaining member 405 coupled to the insert 400. As shown, the tapered neck portion 410 is sized to matingly engage a corresponding tapered portion 504 provided in aperture 404. As should be appreciated by those of ordinary skill in such art, the provision of the corresponding tapered portions 410,504 may prevent shearing of the retaining member 405 which might otherwise occur if there existed an abrupt transition between the head portion 408 and the shank portion 409. To prevent moisture or other contaminants from seeping into aperture 404, a sealing structure 506 may be provided. In an embodiment of the present invention, the sealing structure comprises a conventional o-ring structure which is coupled to the insert 400 adjacent the tapered portion 504. However, it is also contemplated that other arrangements may be used such as attaching the sealing structure 506 to the retaining member 405. To further ensure that no contaminants seep into the aperture 404, the aperture 404 may be formed such that it terminates prior to reaching the bottom surface 507 of the insert 400. It is also contemplated to be within the scope of the present invention that the insert 400 may be provided in an assortment of configurations. For example, for the embodiment shown in FIG. 6, and for reasons which shall become apparent as this disclosure progresses, the insert 400 may be provided with an included flange portion 600.

In an embodiment of the present invention, the outer periphery 401 may include at least one planar portion 415 adapted to matingly engage the planar portion 209 provided in the tail portion opening 208. By providing the aforementioned respective planar portions 415,209, the retaining device 109 is prevented from movement within the tail portion opening 208 when the retaining member 405 is being coupled to the insert 400. It should be understood that the use of an insert 400 of the type described herein is exemplary only and that other arrangements for the retaining device 109 may be utilized. Such other arrangements may include providing the tail portion opening 208 with a threaded portion (not shown) for directly receiving the threaded portion 412 of the retaining member 405.

Figure 7:
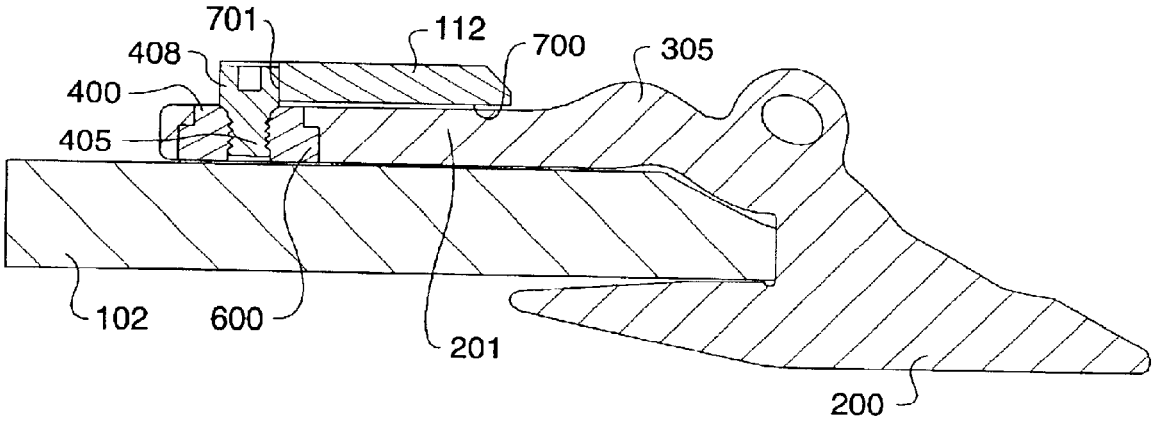
FIG. 7 is a cross-sectional view of the base edge protection system shown attached to the base edge.

Referring to FIG. 7, shown in cross-section is the base edge protector system 100 as attached to the base edge 102. As shown, in an embodiment of the present invention the securing structure 112 may comprise a channel shaped structure which, when attached to the base edge 102, defines a securing structure opening 700 sized to receive the tail portion 201. As should be appreciated by those of ordinary skill in such art, by providing a taper to at least one of the side walls 204 of the tail portion 201, the tail portion 201 may be more easily inserted into, and extracted from, the securing structure opening 700.

The base edge protector 101 is prevented from falling off of the base edge 102 by contact between the head portion 408 of the retaining member 405 and an abutment surface 701 of the securing structure 112. For exemplary purposes only, the abutment surface 701 is shown having a semi-circular notch (as shown best in FIG. 1) sized to receive the head portion 408; however, other configurations of the abutment surface may be utilized without deviating from the scope of the present invention. Furthermore, for those embodiments in which the retaining device 109 includes the insert 400, the insert 400 is prevented from becoming dislodged from the tail portion opening 208 by the overlapping of the securing structure 112 with a portion of the insert 400, as shown, which causes a retaining contact between the insert 400 and the securing structure 112. To prevent dislodging of the insert 400 in those instances where the base edge 102 wears and allows relative movement between the base edge protector 101 and the base edge 102 sufficient to remove the aforementioned overlap, the embodiment of the retaining device 109 shown in FIG. 6 may be utilized in which the flange portion 600 will maintain the retaining device 109 secured to the base edge protector 101 by virtue of a restraining contact between the flange portion 600 and the tail portion 201.

Figure 8:
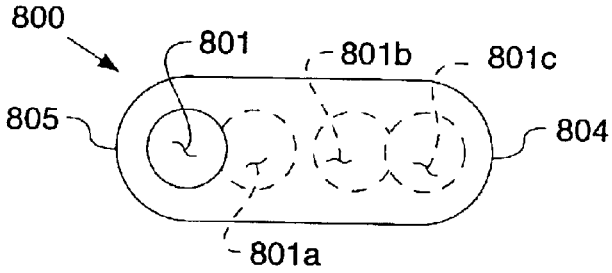
FIG. 8 is a top view of an embodiment of an insert for use with the base edge protection system of the present invention.

With reference now to FIG. 8, shown is an embodiment of the insert, denoted 800, which may be utilized to adjust the tightness of the connection between the base edge protector 101 and the base edge 102. The insert 800 is substantially as illustrated and described above with respect to FIG. 4. However, the insert 800 may be provided with apertures 801 eccentrically located at varying distances along the length of the insert 800 with these aforementioned varying locations shown in alternative detail as 801*a*, 801*b*, and 801*c*. As used herein, the term "eccentric" shall mean that the aperture 801 is not situated at or in the geometric center of the insert 800. For the discussion to follow, and for exemplary purposes only, the alternative position denoted 801*c* will be taken to be equidistantly spaced from the insert side 804 as aperture 801 is from insert side 805. As should be appreciated by those of ordinary skill in such art, the insert 800 may be reversibly placed within the tail portion opening 208 thereby allowing the eccentric location of the aperture 801 to be utilized to tighten the connection between the base edge protector 101 and the base edge 102. In other words, during the initial installation of the base edge protector 101, the insert 800 may be oriented such that the aperture position denoted 801 is closest to the tail portion end 205. As the mating interface between the base edge protector 101 and the base edge 102 wears, the insert 800 may be reversed such that aperture 801 is now in the position formally occupied by the alternate aperture position 801*c*. By reversing the insert 800 in the above-identified manner, an amount of slack equal to the distance between the respective aperture positions 801 and 801*c* may be removed for the connection between the base edge protector 101 and base edge 102. As should also be appreciated, the insert 800 may be replaced by inserts having different eccentric locations of the aperture 801 enabling the user to thereby select the insert that provides the desired fit.

Figure 9:
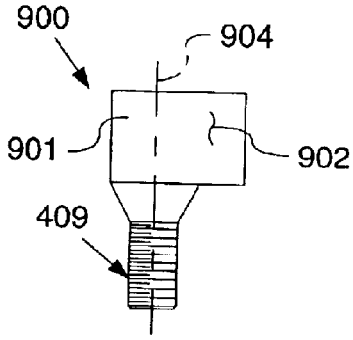
FIG. 9 is a perspective view of an embodiment of a retaining member for use with the base edge protection system of the present invention.
Figure 10:
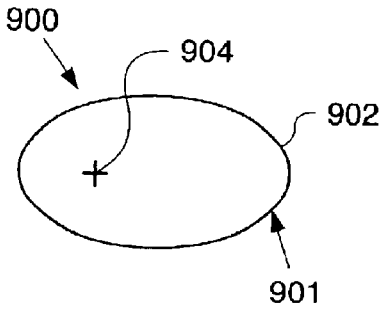
FIG. 10 is a top view of the retaining member of FIG. 9.

With reference now to FIGS. 9 and 10, shown is another embodiment of the retaining member, denoted 900, which may also be utilized to adjust the tightness of the attachment of the base edge protector 101 to the base edge 102. As shown, a head portion 901 of the retaining member 900 may be arranged such that an outer surface 902 of the head portion 901 is variably spaced from a central axis 904 of the shank portion 409. As discussed above, the head portion 901 of the retaining member 900 is arranged to engage the abutment surface 701 of the securing structure 112. As should be appreciated by those of ordinary skill in such art, by providing the retaining member 900 with a head portion 901 having the above-described shape, adjustment of the connection between the base edge protector 01 and the base edge 102 may be accomplished by simply turning the retaining member 900 which causes the base edge protector 101 to move, relative to the base edge 102, by virtue of the contact between the head portion 901 and the abutment surface 701.

Figure 11:
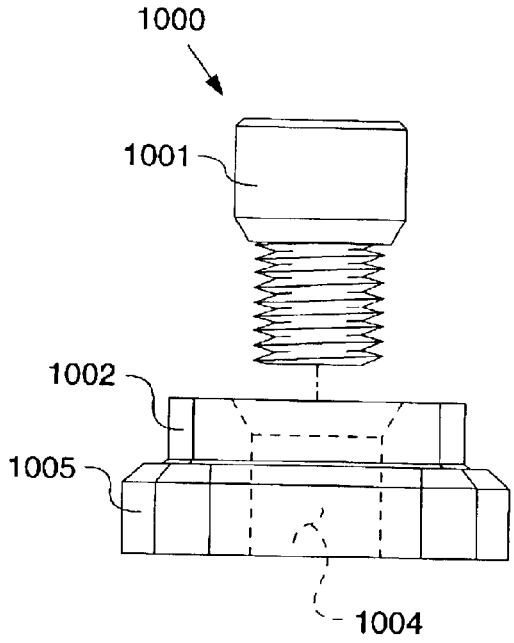
FIG. 11 is an elevation view of yet still another embodiment of a retaining device for use with the base edge protector system of the present invention.
Figure 12:
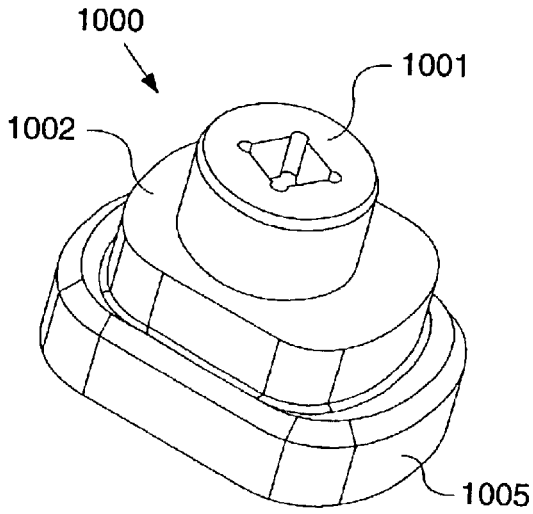
FIG. 12 is a perspective view of the retaining device of FIG. 11.

Shown in FIGS. 10 and 11 are, respectively, an elevation view and a perspective view of yet still another embodiment of a retaining device of the present invention denoted as 1000. The retaining device 1000 includes a retaining member tool which is substantially as illustrated and described previously with regards to aforementioned embodiments. The retaining device 1000 further includes an insert 1002 which is provided with an aperture 1004 that may be eccentrically located at varying distances along the length of the insert 1002. The insert 1002 is also provided with a flange portion 1005.

INDUSTRIAL APPLICABILITY

In use and in operation, the base edge protection system 100 of the present invention is adapted for attachment to the base edge 102 of the bucket in order to protect the base edge 102 from wear and other damage which may occur if the base edge 102 were allowed to directly contact the material being acted upon by the bucket. With reference to FIG. 7, the application of force to the shroud portion 200, such as would occur if the shroud portion 200 were supporting a load or otherwise being caused to meet with a resistance, causes contact between the tail portion 201 and the securing structure 112. This results in those reactionary forces that are traditionally borne by the retaining device 109 to now be borne by the larger tail portion 201, thereby potentially extending the useful life of the retaining device 109.

In addition, the present invention also provides for adjustment of the fit between the base edge protector 101 and the base edge 102 which may be required from time-to-time to compensate for any wear between the base edge protector 101 and the base edge 102. With reference to the embodiment shown in FIG. 8, the present invention provides for an insert 800 having both an eccentrically placed aperture 801 and the ability to be reversibly inserted within the tail portion opening 208. As should be appreciated, the user desiring to tighten the connection between the base edge protector 101 and the base edge 102 only need to reverse the placement of the insert 800 within the tail portion opening 208. This will effectively decrease the distance from the aperture 801 to the abutment surface 701 of the securing structure 112 thereby providing for the aforementioned ability to tighten the connection between the base edge protector 101 and the base edge 102. Furthermore, it is contemplated to be within the scope of the present invention to provide inserts 800 having varying degrees of eccentric placement of the aperture 801, thereby allowing the user to select the insert 800 which will provide the right fit. For the embodiment shown in FIG. 9, adjustment of the fit between the base edge protector 101 and the base edge 102 may be simply accomplished by rotation of the retaining member 405 which causes the base edge protector 101 to move accordingly, relative to the base edge 102, due to contact between the head portion 408 and the abutment surface 701.

Other aspects, objects and advantages of this invention can be obtained from a study of the drawings, the disclosure and the appended claims.

What is claimed is:

1. A base edge protector system for use with a base edge having at least one securing structure attached therewith, the securing structure defining with the base edge a securing structure opening, comprising a base edge protector comprising: (i) a shroud portion, and (ii) a tail portion having a first end, a middle portion, and a second end opposite the first end, the first end attached to the shroud portion, the middle portion positioned in the securing structure opening, and the second end extending out from the securing structure opening; and a retaining device attached to said second end of said tail portion.

2. The base edge protector system as set forth in claim 1 wherein:

said tail portion comprises a tail portion opening adapted to receive said retaining device;

said tail portion opening comprises at least one planar portion; and said retaining device comprises an insert having at least one planar portion adapted to matingly engage said planar portion of said tail portion opening.

3. The base edge protector system as set forth in claim 2 further comprising a retaining member for receipt within an aperture provided in said insert.

4. The base edge protector system as set forth in claim 3 further comprising a sealing structure located between said retaining member and said insert.

5. The base edge protector system as set forth in claim 3 wherein said insert may be provided with an aperture provided at user selected locations along a length of said insert.

6. The base edge protector system as set forth in claim 3 wherein said retaining member comprises a head portion adapted to lie adjacent an abutment surface of the securing structure when said base edge protector is attached to the base edge.

7. The base edge protector system as set forth in claim 3 wherein:

said retaining member has a central axis;

said retaining member comprises a head portion having an outer surface; and said outer surface is variably spaced from said central axis.

8. The base edge protector system as set forth in claim 1 wherein said retaining device comprises an insert having a flange portion attached therewith.

9. A method of providing an adjustable base edge protector system for protecting a base edge, comprising the steps of:

providing a base edge protector having a tail portion;

providing the base edge with a securing structure, said securing structure defining with said base edge a securing structure opening for receiving said tail portion, said securing structure further comprising an abutment surface; and providing said tail portion with a retaining device adapted to engage said abutment surface and wherein variations in a position of said retaining device causes variations in a relative position of said base edge protector and the base edge.

10. The method of providing an adjustable base edge protector system as set forth in claim 9 wherein said retaining device comprises a retaining member having a central axis and an outer surface variably spaced from said central axis, said outer surface structured and arranged to engage said abutment surface of said securing structure.

11. The method of providing an adjustable base edge protector system as set forth in claim 10 further comprising the step of providing a retaining member that is rotatably attached to said tail portion.

12. The method of providing an adjustable base edge protector system as set forth in claim 9 wherein said retaining device comprises an insert having an aperture provided at user selected locations along a length of said insert.

13. The method of providing an adjustable base edge protector system as set forth in claim 12 wherein said aperture is eccentrically located on said insert.

14. The method of providing an adjustable base edge protector system as set forth in claim 12 wherein said retaining device further comprises a retaining member adapted for receipt within said aperture and having a head portion adapted to lie adjacent the abutment surface of the securing structure when said base edge protector is attached to the base edge.

15. A method of providing a base edge of a working implement with an adjustable base edge protection system, the method comprising:

positioning a base edge protector on the base edge in a first position relative to the base edge;

engaging the base edge protector with a retaining device to secure the base edge protector in the first position, the retaining device positioned in a first orientation with respect to the base edge protector;

detaching the retaining device;

positioning the base edge protector on the base edge in a second position relative to the base edge, the second position being different from the first position; and reengaging the base edge protector with the retaining device to secure the base edge protector in the second position, the retaining device positioned in a second orientation different from the first orientation with respect to the base edge protector.

16. The method of claim 15 wherein the second orientation of the retaining device is obtained by rotating the retaining device 180° around a central axis from the first orientation.

17. A method of providing a base edge of a working implement with an adjustable base edge protection system, the method comprising:

positioning a base edge protector on the base edge in a first position relative to the base edge;

engaging the base edge protector with a first retaining device to secure the base edge protector in the first position;

disengaging the first retaining device;

positioning the base edge protector on the base edge in a second position relative to the base edge, the second position being different from the first position; and engaging the base edge protector with a second retaining device to secure the base edge protector in the second position.

* * * * *